US005836065A

United States Patent [19]

Dehlinger et al.

[11] Patent Number: 5,836,065

[45] Date of Patent: Nov. 17, 1998

[54] EXTENDED JACKET END, DOUBLE EXPANSION HYDROFORMING

[75] Inventors: James R. Dehlinger, Ada; Roger A. Crawford, Muskegon; Wallace J. Poole, Fremont; Robert A. Shaffer, Comstock Park; Donald R. VandePolder, Grand Rapids, all of Mich.

[73] Assignee: Benteler Automotive Corporation, Grand Rapids, Mich.

[21] Appl. No.: 721,548

[22] Filed: Sep. 26, 1996

Related U.S. Application Data

[62] Division of Ser. No. 522,172, Aug. 31, 1995, Pat. No. 5,673,470.

[51] Int. Cl.[6] ..... B23P 23/00; B21D 26/02

[52] U.S. Cl. ..... 29/33 T; 72/62

[58] Field of Search ..... 29/455.1, 890.08, 29/890.036, 421.1, 33 T; 72/58, 61, 62

[56] References Cited

U.S. PATENT DOCUMENTS

| | | | |
|---|---|---|---|
| 5,107,693 | 4/1992 | Olszewski | 72/58 |
| 5,170,557 | 12/1992 | Rigsby | 29/890 |
| 5,189,790 | 3/1993 | Streubel | 29/890 |
| 5,363,544 | 11/1994 | Wells | 29/523 |
| 5,475,911 | 12/1995 | Wells et al. | 29/421.1 X |

FOREIGN PATENT DOCUMENTS

| | | |
|---|---|---|
| 0494843 | 7/1992 | European Pat. Off. . |
| 4019899 | 6/1990 | Germany . |

*Primary Examiner*—S. Thomas Hughes
*Attorney, Agent, or Firm*—Price, Heneveld, Cooper, DeWitt and Litton

[57] ABSTRACT

Hydroforming double wall tubular stock into an air gap tubular element comprising providing a plural wall tubular workpiece having at least an inner wall liner and an outer wall jacket having adjacent open axial ends, causing at least one of the jacket ends to extend axially beyond the adjacent liner end and to be flared outwardly, placing the workpiece into a first mold cavity of a size and configuration to result in the desired size and configuration of the liner, sealing the open ends of said liner, injecting hydroforming fluid into said liner to fill it and applying pressure thereto to expand the liner and jacket in the first mold cavity, releasing the pressure, placing the workpiece in a second mold cavity of a size and configuration desired for the jacket on a resulting air gap tubular element, providing hydroforming end closures to seal off the jacket ends, at least one of the end closures having an annular shoulder aligned with the flared extended jacket end radially outwardly offset from the adjacent liner end, pressing the annular shoulder directly against the flared jacket end to seal the flared jacket end between the shoulder and an anvil surface, injecting fluid into the workpiece to fill it and applying pressure to expand only the jacket.

3 Claims, 2 Drawing Sheets

EXTENDED JACKET END, DOUBLE EXPANSION HYDROFORMING

This is a divisional of application Ser. No. 08/522,172, filed on Aug. 31, 1995, and now U.S. Pat. No. 5,673,470.

BACKGROUND OF THE INVENTION

This invention relates to hydroforming of dual wall air gap conduits, for use, for example, as automotive exhaust gas conducting conduits.

Hydroforming of multi-wall, usually dual wall, conduits having a controlled air gap between the inner wall liner and the outer wall jacket is now practiced as taught, for example, in U.S. Pat. Nos. 5,170,557 and 5,363,544.

If the inner and outer walls are both to be expanded from the original workpiece, the technology in U.S. Pat. No. 5,363,544 has been found to be highly effective. If only the outer jacket is to be expanded, the method in U.S. Pat. No. 5,170,557, or the second step of the process in U.S. Pat. No. 5,363,544 can be employed. Such methods and apparatus typically involve the steps of forming orifices in the inner liner. Also, the end plugs of these apparatuses employ special seals which are complex. Unfortunately, these are costly and tend to wear out.

SUMMARY OF THE INVENTION

An object of this invention is to provide a hydroforming method and apparatus for a plural wall, usually a double wall, conduit having an outer jacket and an inner liner. It enables the outer jacket to be expanded, or alternatively enables the inner liner and the outer jacket to be simultaneously expanded and then the outer jacket to be expanded further, but without requiring the step of forming orifices in the inner liner, and without the special complex seal arrangements previously employed.

The hydroforming apparatus comprises a mold defining a first cavity having ends, at least one end of which has an outwardly flared outer support, a pair of end closures adjacent these ends, at least the one end closure adjacent the flared outer support being tapered to cooperate with the flared outer support to squeeze and seal ends of the workpiece liner and jacket during hydroforming, a first hydroforming inlet orifice in the one end closure to the first cavity for entry of and pressurization of hydroforming fluid into the liner of the workpiece for expansion of both the liner and jacket, a mold defining a second mold cavity having ends, at least one end of which has an outwardly flared anvil, a second pair of end closures adjacent the second cavity ends, at least one of said end closures and flared anvil being cooperative for squeezing and sealing the end of just said workpiece jacket, a second hydroforming orifice in the one end closure to said second cavity for entry of and pressurization of hydroforming fluid into the liner and between the liner and jacket for expansion of the jacket. The at least one first cavity end of the first mold cavity is preferably flared at a first acute angle of about 20°. The at least one end of the second cavity is flared at a second acute angle larger than the first acute angle, preferably about 25°.

The method comprises providing a plural wall tubular workpiece having at least an inner liner and an outer jacket, having adjacent open axial ends, at least one of the jacket ends extending axially beyond the adjacent liner end and flared outwardly, placing the workpiece in a mold cavity having a size and configuration desired for the jacket on the resulting air gap tubular element, providing hydroforming end closures to seal off the jacket ends, at least one of said end closures having an annular shoulder aligned with the extended flared jacket end axially and radially outwardly offset from the adjacent liner end, providing an anvil behind the flared jacket end, pressing the annular shoulder against only the flared jacket end to seal the flared jacket end between the shoulder and anvil, injecting hydroforming fluid into the workpiece, and applying sufficient pressure to expand and reform the jacket into the mold cavity. The end is preferably flared to an acute angle of about 25°.

The method can alternatively comprise placing the workpiece with the extended jacket end into a first mold cavity of a size and configuration to result in the desired size and configuration of the liner, sealing said adjacent ends of both the jacket and the liner to each other and also sealing the open ends of the liner, injecting hydroforming fluid into the liner and applying pressure thereto to expand and reform the liner and jacket in the first mold cavity, releasing the pressure, placing the workpiece in a second mold cavity of a size and configuration desired for the jacket on the resulting air gap tubular element, providing hydroforming end closures to seal off the jacket ends, at least one of the end closures having the annular shoulder aligned with the flared jacket end outwardly offset from the adjacent liner end, providing an anvil behind the flared jacket end, pressing the annular shoulder against the flared jacket end to seal the flared jacket end between the shoulder and the anvil, injecting hydroforming fluid into the workpiece and applying sufficient pressure to expand and reform the jacket into the second mold cavity.

DESCRIPTION OF THE PREFERRED EMBODIMENT

Figure 1:
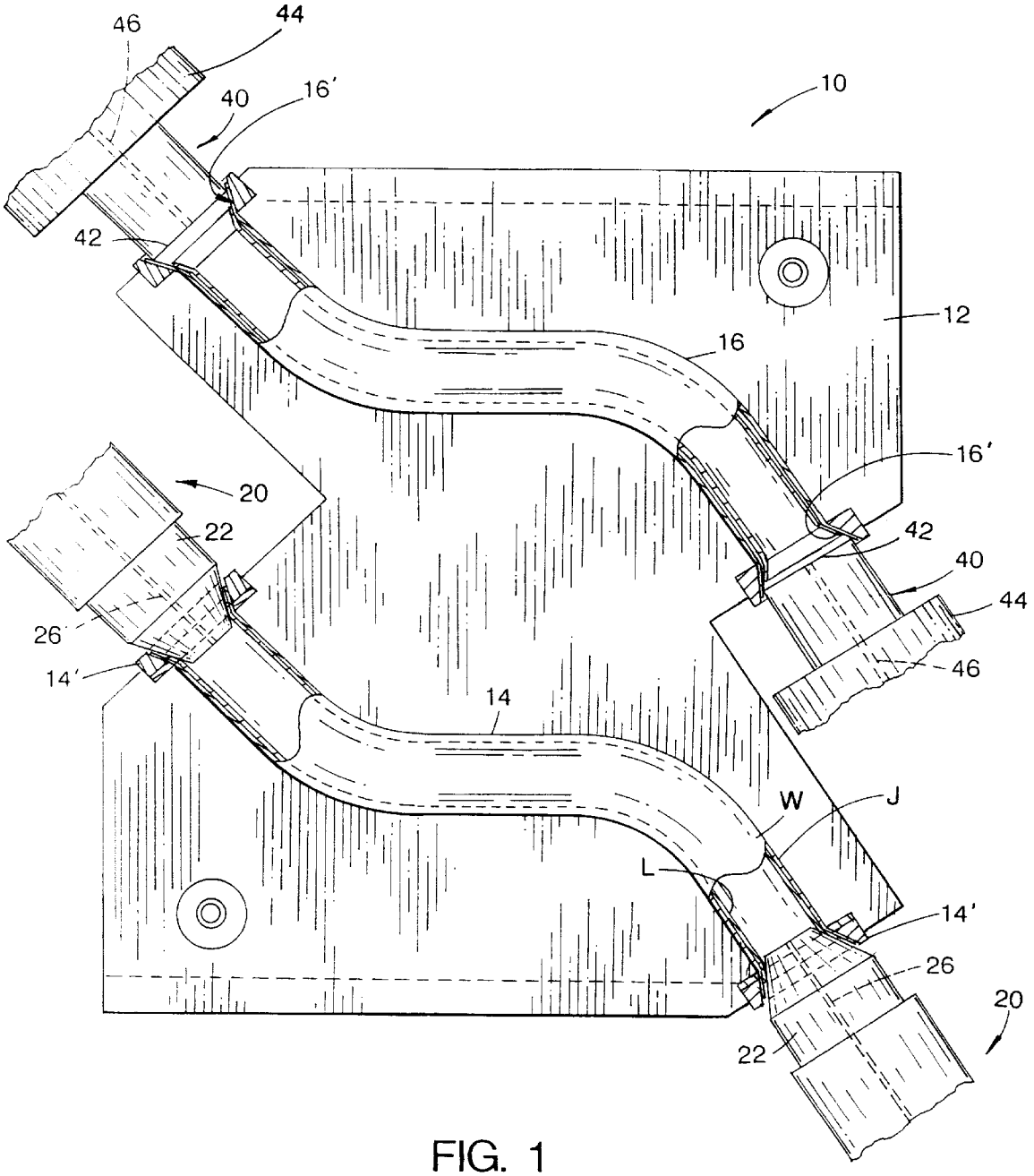
FIG. 1 is a plan view of a mold including first and second mold cavities and shown to contain first and second workpieces, the workpiece in the top cavity having the outer jacket expanded to create the air gap between the jacket and the inner liner.

Referring now specifically to the drawings, the assembly 10 is shown to include a mold 12 which is comprised of two like mating cooperative parts, only the lower portion of which is depicted, but the upper portion not depicted being a mirror image thereof as set forth, for example, in FIG. 4 of U.S. Pat. No. 5,363,544 incorporated herein by reference. This mold has first and second mold cavities 14 and 16. First mold cavity 14 is shown to have a predetermined nonlinear configuration, of the general shape to be provided to the final product. The diameter of mold cavity 14 is chosen to result in the final desired width or diameter of the inner liner element of the workpiece after expansion, as described hereinafter, taking into consideration the thickness of the workpiece outer jacket. Similarly, mold cavity 16 has a configuration generally matching that of cavity 14, but has an outer diameter of a larger size selected to provide the desired final diameter of the outer jacket of the workpiece after expansion, as described hereinafter.

The opposite ends of mold cavity 14 are outwardly flared in a frustoconical manner and preferably include an annular outer support ring 14' on each end defining this outward flare. The combination mold cavity 14 and surfaces of rings 14' define a cavity surface to accommodate workpiece W. This workpiece to be hydroform expanded comprises an inner, metal, preferably steel, and most preferably stainless steel, tube or tubular element to form a thin liner, and an outer, thicker tubular element, also of metal, and preferably steel, most preferably stainless steel, to form a jacket. The inner diameter of the outer tube element basically coincides with the outer diameter of the inner tube element prior to hydroforming, such that normally the initial workpiece has 360° contact between the two elements along the length thereof. The tube elements of the initial workpiece are typically circular in cross section, not yet having the flared end portions depicted in the drawings. Conceivably, however, the ends could be previously flared prior to placement in the first hydroforming cavity, e.g., when the tubes are pulled or rammed together or when the double tube is bent to effect the desired nonlinear configuration or angles therein. Furthermore, some double wall conduits or conduit portions need not have any bend zones, such that the cavities would have straight centerlines. If the ends are previously flared, it is still desirable to have tapered noses on the end plug for the first cavity, to hold the tubes on center in the cavity. This workpiece comprises a multiple wall, usually double wall, element including inner liner L and outer jacket J. This workpiece typically will have been previously mechanically created as by being extruded or rolled from a flat sheet and joined at an elongated seam, and then formed as by medium bending to the desired general configuration such as that shown. In the preferred embodiment depicted, the double walled structure is converted into an air gap assembly wherein the inner liner and outer jacket engage each other only at the axial ends, but are spaced from each other by an air gap along the remainder of the length of the workpiece. This air gap structure can be expanded by the two stage hydroforming process depicted and described hereinafter. Alternatively, only the outer jacket may in some instances be expanded. If the initial step of forming comprises media deforming, water or some other liquid or ice or deformable solid is employed as the medium filling the workpiece.

If the air gap tube is to be employed as a vehicle exhaust conduit, preferably the materials set forth in U.S. Pat. No. 5,170,557 are employed, such reference being incorporated herein by reference.

In the hydroforming apparatus depicted, a first pair of fluid cylinders 20 form a first pair of actuators to axially shift end closure elements 22 preferably having convergently tapered ends 24 (FIG. 2) toward the mold. Preferably the angle of taper of these ends is an acute angle of about 20°. Likewise, the cooperative support rings 14' have a matching angle. Rings 14' preferably have a backup ring 15 of a perishable, i.e., softer, material to assure sealing against fluid leakage of tapered ends 24 to inner liner L. The flared ends of the liner and jacket can actually be mechanically formed by tapered ends 24, or can be preformed prior to placement into mold cavity 14. At least one of end closures 22 includes a hydroforming fluid entry flow passage 26 extending therethrough and opening into the chamber of liner L to enable fluid to fill the liner. The other end closure will preferably have an air outlet passage therethrough to assure absence of air pockets in the filled liner. High pressure is applied to the liner-filled fluid for hydroforming the liner and jacket into an expanded configuration until the jacket matches the surface of mold cavity 14.

Figure 3:
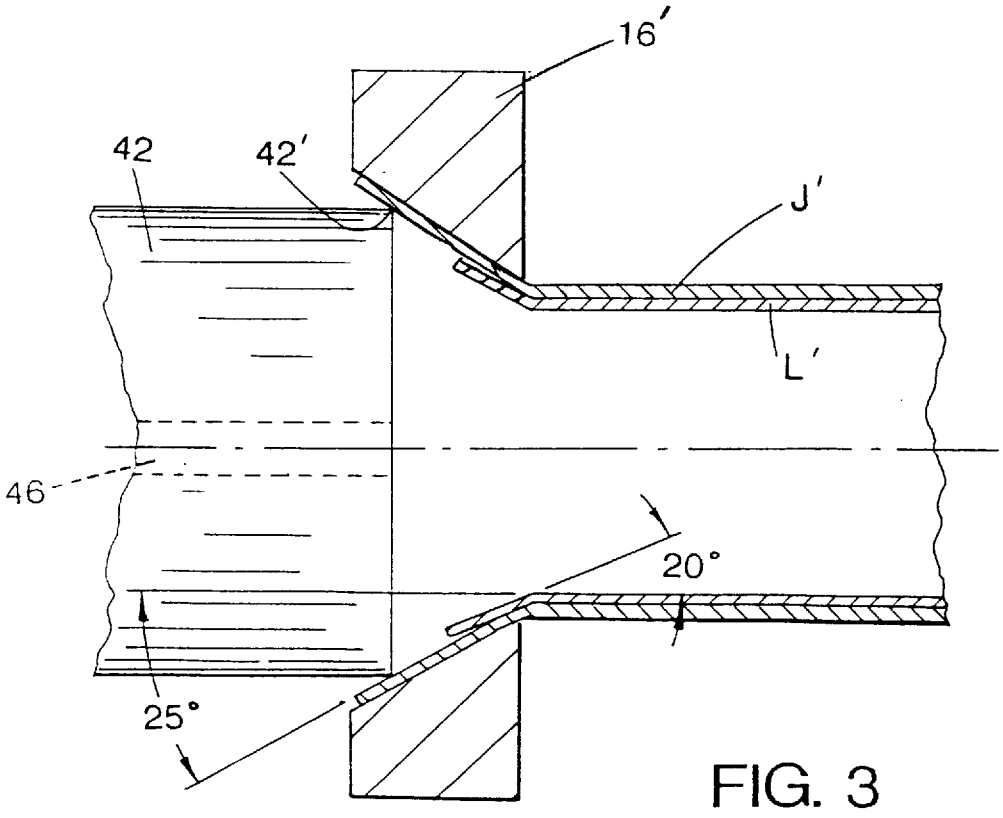
FIG. 3 is an elevational, sectional view through one end of the second mold cavity including the end closure and workpiece, prior to the jacket being expanded to create the air gap.

Mold cavity 16 also includes a pair of flared ends, the flared ends preferably being defined by a pair of annular anvils 16'. The tapered surfaces of these anvils, at least at one end of the workpiece and the cavity 16, have an axially outer portion at a somewhat larger acute angle than the angle in cavity 14, most preferably about 25° if the angle in cavity 14 is about 20°. The anvils also have a portion at an angle of about 20°, i.e., matching that of the first mold cavity, axially inwardly of the 25° portion, as depicted in FIG. 3.

End closures are provided at the second mold cavity 16 by fluid actuators 40 which include a fluid cylinder 44 and a piston rod 42 which serves as the end closure, having a cylindrical outer end with an annular peripheral edge 42' of a diameter less than the maximum diameter of the flared outer jacket end, but greater than the maximum diameter of the flared inner liner end. This edge 42' serves as a sealing shoulder. For purposes of convenience, the workpiece in mold 16 is identified as W', made up of partially expanded outer jacket 3' and expanded inner liner L', as previously expanded in cavity 14. The peripheral edge 42' of each of end closures 42 engages the respective extended end of jacket 3' axially beyond, i.e., outwardly of, the end of liner L', and forces the flared jacket ends out further, into sealing engagement with the backup anvils 16'. A fluid passageway 46 extends through at least one of end closures 42 to the space inside the jacket and liner so that fluid can be pumped into the liner and jacket to fill the cavity, and pressure is then applied by a high pressure pump or the like for hydroforming. The second end closure preferably has a passageway for escape of air from the workpiece to assure complete filling of the space within the workpiece. The annular shoulder 42' is axially and radially offset from the flared end of liner L' to press directly against the flared end of jacket J' and force it against anvil 16'. The 25° angle portion of anvil 16' causes the flared end of jacket J' to be deformed by shoulder 42' away from the adjacent flared end of liner L' another 5° or so as shown, to create a space or gap between them. This assures fluid flow between the liner and jacket when pressure is applied, to thereby cause the pressure inside and outside of liner L' to be the same, thus causing jacket J' to be expanded under the pressure, but liner L' to retain its previously formed dimension. Since fluid is forced into workpiece W' from only one end, it may be decided to have the larger acute angle at only one end of cavity 16.

In practice of the novel method, the workpiece which has been previously configurated to a desired general configuration such as that depicted in FIG. 1, formed with an inner liner and an outer jacket, is placed in a mold cavity. If both the liner and jacket are to be expanded by hydroforming, the two stage process described below and depicted in FIG. 1 is employed. If only the jacket is to be expanded, only the second stage of the process described may be employed.

Figure 2:
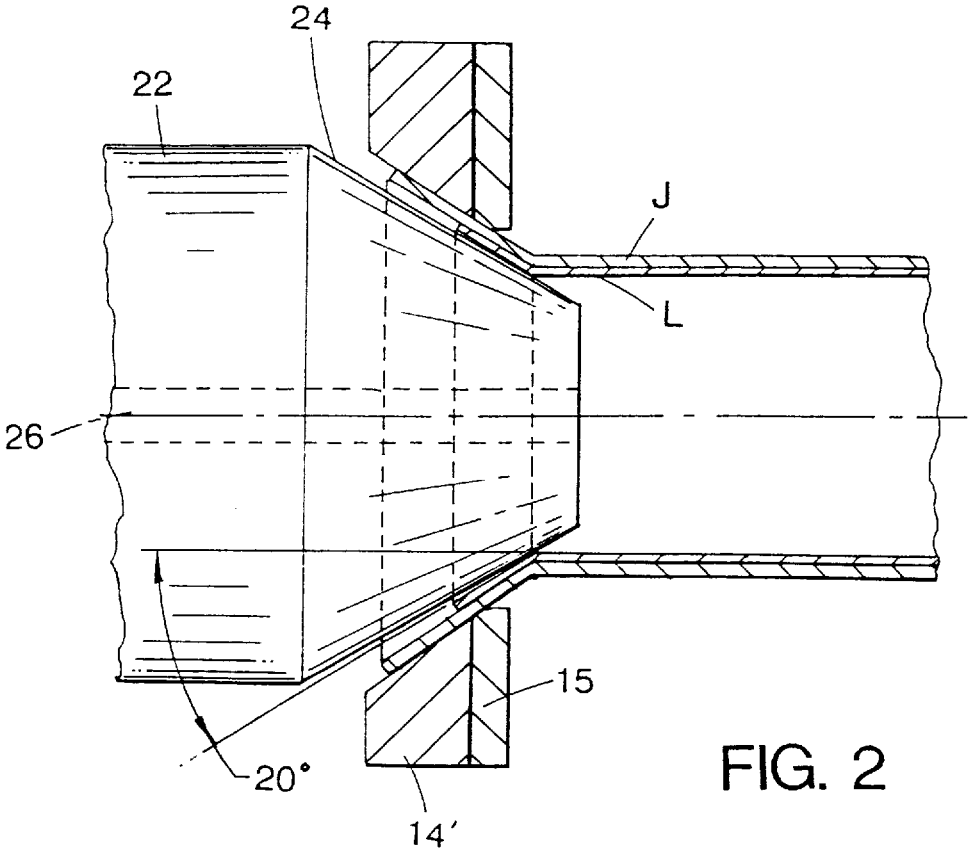
FIG. 2 is an elevational, sectional view through a portion of the first mold cavity in FIG. 1, and including the end closure and workpiece.

With workpiece W comprising inner liner L and outer jacket J placed in mold cavity 14, the ends, either previously flared or flared in this first stage, are tightly sealed against the flared support rings 14' by axial extension of both end closures 22, utilizing fluid cylinders 20 or the equivalent. This forces the tapered inner ends 24 against the inner liner flared end, this liner thus being forced radially outwardly against the outer jacket flared ends, and against support rings 14', to seal the assembly at both ends. Fluid is then injected through passageway 26 while air is evacuated from the opposite passageway until the cavity within the liner and jacket is completely filled with the hydroforming fluid such as water. At that time the end closure passageway that allowed air to escape is closed and high pressure is applied to the fluid, typically using the passageway 26 through which the fluid entered. This causes both the liner and the jacket to be expanded until the jacket outer surface conforms exactly to mold cavity 14 configuration. Pressure is subsequently released, the mold is opened, and workpiece W is placed in the second mold cavity 16 as workpiece W'. At that time a new workpiece W can be placed in mold cavity 14 so that the mold is serving a double function. After the mold is closed, fluid actuators 40 extend end closure plungers 42 toward cavity 16 to engage only the outer jacket flared end as depicted in FIG. 2, forcing the jacket further outwardly at a small angle from the free ends of the adjacent liner and sealing the jacket tightly against the anvil rings 16'. Fluid is then injected through passageway 46 while air is preferably evacuated from the opposite like passageway, totally filling workpiece W' with the hydroforming fluid. Excess pressure is then applied through the passageway to put the interior of the workpiece under deforming pressures, the fluid being free to apply pressure on both the inner and outer surface of liner L' in an equal amount so that it does not change in dimension, while the jacket only has pressure applied to its inner surface to thereby expand it to the dimension of cavity 16 and the desired gap spacing from liner L', the gap being shown, for example, in FIG. 1. Thereafter, pressure is relieved, the mold is opened, and fluid is drained from the workpiece. Optionally, the two flared ends of the workpiece can be removed as offal.

As will be apparent, the elaborate seal arrangement previously employed is not necessary. Thus, the equipment is simplified and maintenance is minimized.

Instead of the two stage process described above in detail, only the second stage need be used if it is desired to expand the jacket but not first expand both the jacket and the liner.

Those persons knowledgeable in the art may conceive of certain variations in the detailed process disclosed as illustrative, to suit particular circumstances or product to be formed. The invention is therefore not intended to be limited to the preferred embodiment depicted, but only by the scope of the appended claims and the reasonably equivalent apparatus and methods to those defined therein.

The embodiments of the invention in which an exclusive property or privilege is claimed are defined as follows:

1. Hydroforming apparatus for forming a dual wall air gap conduit having an inner wall liner and an outer wall jacket, said liner and jacket having adjacent ends with at least one jacket end extending axially beyond the adjacent liner end, said apparatus comprising:

a mold defining a first cavity having ends, at least one end of which has an outwardly flared outer support;

a pair of end closures adjacent said first cavity ends, at least the one end closure adjacent said flared outer support being configurated to cooperate with said flared outer support to squeeze and seal said adjacent ends of said liner and jacket during hydroforming;

a first hydroforming inlet orifice in said at least one end closure to said mold first cavity for entry of and pressurization of hydroforming fluid into a liner of a workpiece for expansion of both the liner and jacket;

a mold defining a second mold cavity having ends, at least one end of which has an outwardly flared anvil;

a second pair of end closures adjacent said second cavity ends, at least one of said second pair of end closures and said flared anvil being dimensioned and configured to be cooperative for squeezing and sealing the flared end of just said workpiece jacket and not said liner, thereby forming a sealing shoulder having a diameter radially and axially offset from the adjacent liner end;

a second hydroforming orifice in said at least one end closure to said mold second cavity for entry of and pressurization of hydroforming fluid into said liner and between said liner and said jacket for expansion of said jacket and not said liner.

2. Hydroforming apparatus for forming a dual wall air gas conduit having an inner wall liner and an outer wall jacket, said liner and jacket having adjacent ends with at least one jacket end extending axially beyond the adjacent liner end, said apparatus comprising:

a mold defining a first cavity having ends, at least one end of which has an outwardly flared outer support;

a pair of end closures adjacent said first cavity ends, at least the one end closure adjacent said flared outer support being configurated to cooperate with said flared outer support to squeeze and seal said adjacent ends of said liner and jacket during hydroforming;

a first hydroforming inlet orifice in said at least one end closure to said mold first cavity for entry of and pressurization of hydroforming fluid into a liner of a workpiece for expansion of both the liner and jacket;

a mold defining a second mold cavity having ends, at least one end of which has an outwardly flared anvil;

a second pair of end closures adjacent said second cavity ends, at least one of said second pair of end closures and said flared anvil being dimensioned and configured to be cooperative for squeezing and sealing the flared end of just said workpiece jacket and not said liner, thereby forming a sealing shoulder having a diameter radially and axially offset from the adjacent liner end;

a second hydroforming orifice in said at least one end closure to said mold second cavity for entry of and pressurization of hydroforming fluid into said liner and between said liner and said jacket for expansion of said jacket and not said liner;

said at least one first cavity end being flared at a first acute angle and said at least one second cavity end being flared at a second acute angle larger than said first acute angle.

3. The apparatus in claim 2 wherein said first acute angle is about 20° and said second acute angle is about 25°.

* * * * *

UNITED STATES PATENT AND TRADEMARK OFFICE

CERTIFICATE OF CORRECTION

PATENT NO. : 5,836,065
DATED : November 17, 1998
INVENTORS : James R. Dehlinger et al.

It is certified that error appears in the above-identified patent and that said Letters Patent is hereby corrected as shown below:

Column 4, lines 17 and 20, "3'" should be --J'--.

Column 6, claim 2, line 16, "gas" should be --gap--.

Signed and Sealed this

Thirteenth Day of July, 1999

*Attest:*

*Attesting Officer*

Q. TODD DICKINSON

*Acting Commissioner of Patents and Trademarks*